United States Patent [19]

Asplund et al.

[11] 3,936,282

[45] Feb. 3, 1976

[54] VACUUM CLEANER AND TEMPERATURE-RESPONSIVE MOTOR COOLING DEVICE

[75] Inventors: Ivar Asplund, Solna; Karl Arvid Henning Waara, Stockholm, both of Sweden

[73] Assignee: Aktiebolaget Electrolux, Stockholm, Sweden

[22] Filed: Feb. 27, 1975

[21] Appl. No.: 553,540

[30] Foreign Application Priority Data

Mar. 1, 1974 Sweden ..... 7402728

[52] U.S. Cl. ..... 55/217; 15/319; 236/87

[51] Int. Cl.[2] ..... B01D 46/02

[58] Field of Search ..... 55/217, 274, 309, 310, 55/312, 472, DIG. 3, DIG. 34; 15/317, 319; 236/87

[56] References Cited

UNITED STATES PATENTS

| | | | |
|---|---|---|---|
| 2,933,257 | 4/1960 | Clark | 236/80 F |
| 3,232,030 | 2/1966 | Owenmark | 55/217 |

*Primary Examiner*—Bernard Nozick

*Attorney, Agent, or Firm*—Alfred E. Miller

[57] ABSTRACT

A motor cooling arrangement and device for a vacuum cleaner which is provided with a temperature sensitive means that communicates with a valve and acts on a valve diaphragm when the motor temperature exceeds a predetermined level. When the valve is opened, atmospheric air is permitted to pass into both the dust collecting space and the space housing the motor. In the latter space the motor is subject to an increased air flow that functions to improve the cooling of the working motor.

6 Claims, 3 Drawing Figures

VACUUM CLEANER AND TEMPERATURE-RESPONSIVE MOTOR COOLING DEVICE

BACKGROUND OF THE INVENTION

In vacuum cleaners utilizing suction to pick up dirt and dust, it is known that the air flow through the vacuum cleaner, after having the dust and dirt particles removed, functions to cool the motor. However, this air flow is reduced successively upon continued use of the vacuum cleaner due to the clogging of the pores in the container walls, and the increased pressure reduction by the container walls. The result is an increased load on the motor as well as the risk of overheating of the motor.

It is known to provide overheating protection to a vacuum cleaner motor in order to avoid damage thereto due to insufficient cooling of the motor when the dust cannister is clogged to a certain degree. One such overheating protection device is described in Swedish Pat. No. 192,337 in which a temperature sensing body is used that is filled with liquid and connected to a servomotor constituted of a closed bellows. In this device, when the motor temperature increases, the liquid present in the device expands and the volume increase is propelled through a conduit to the bellows which then enlarges lengthwise. The bellows is caused to move and this movement is transmitted through a rod to a valve body that moves to open an opening in the casing for supplying atmospheric air to the motor-fan unit. Thus, air, in this known arrangement, moves directly to the fan without first passing through the dust container. Desirably, the motor is cooled to a normal operating temperature, and the risk of overloading and overheating the motor is eliminated.

The above described known device has a serious drawback in that it is expensive to manufacture because of its relatively complex construction. Furthermore, the use of liquid-filled receptacles and conduits presents a danger in that there is always a risk of leakage from this arrangement due to the vibrations which occur when the vacuum cleaner motor is switched on. Interruption of the vacuum cleaner operation may be the unwanted result.

SUMMARY OF THE INVENTION

This invention relates to device for use with vacuum cleaners having at least one fan driven by a motor unit for drawing air into the vacuum cleaner and separating the dust in the dust container, and the device constitutes a temperature sensing means for said motor unit and a communication channel between the atmosphere and the suction side of the fan depending upon the temperature of the motor unit in order to open the channel.

It is an object of the present invention to provide protection against the overheating of a vacuum cleaner motor that is simple in construction and requires less space than other devices and arrangements constructed for the same purpose.

A further object of the present invention is to provide a protective device against overheating of a vacuum cleaner motor which is safe in operation and does not require the use of liquid in the system.

Another object of the present invention is to provide a valve for opening and closing the air supply to the interior of the vacuum cleaner housing. The valve has a diaphragm, one side of which communicates with the space between the dust container and the suction side of the fan and the other side of the diaphragm communicates with a space having higher pressure through an air conduit. Moreover, a blocking means is provided which is associated with the conduit and is acted upon by the temperature sensing means in such a manner that it opens the conduit to the atmosphere when the temperature of the motor is too high.

The invention will now be more fully described with reference to the accompanying drawings, in which.

DESCRIPTION OF THE PREFERRED EMBODIMENT

Figure 1:
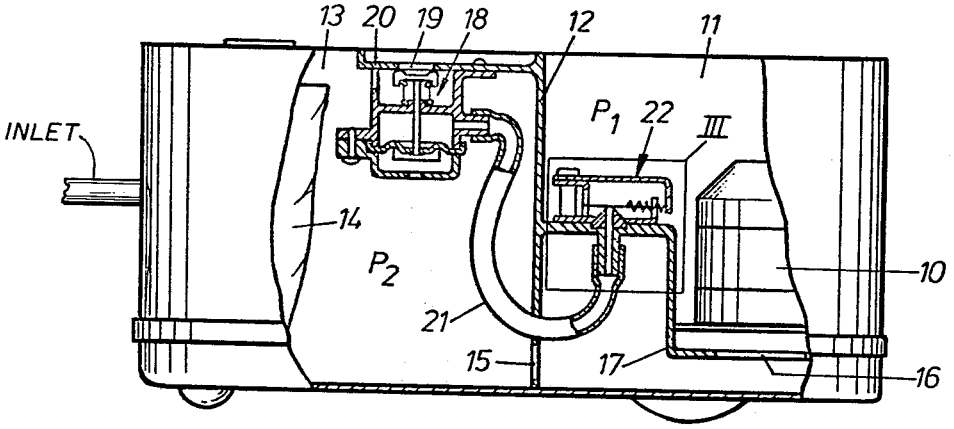
FIG. 1 is an elevational view of the device partly in section, and showing the temperature sensing assembly on an enlarged scale.

Referring to FIG. 1, a vacuum cleaner is shown having the general configuration V. A motor 10 is mounted in the space 11 that is separated from the dust collecting space 13 having a dust receptacle 14 by means of a partition 12. The dust collecting space 13 communicates with the suction side of the motor-fan unit through an opening 15 in the partition wall 12 and another opening 16 in the wall 17 adjacent to the motor and supporting the latter.

Figure 2:
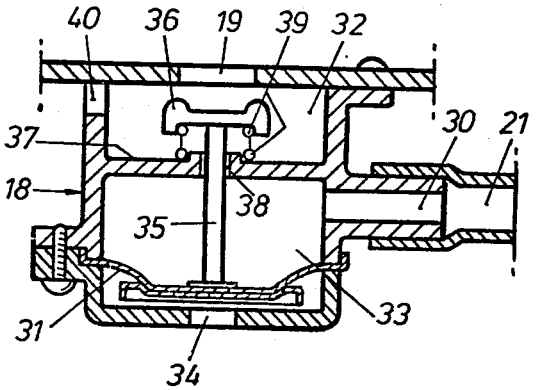
FIG. 2 is a sectional view on an enlarged scale of the valve incorporated in the present device, said valve being shown in its open position

As seen in FIGS. 1 and 2, the dust collecting space 13 is provided with a valve structure 18 which opens or closes an opening 19 in the upper wall 20 of the valve. The valve 18 is connected to a temperature sensing assembly 22 located in the motor space 10 through an air conduit 21. The sensing means is shown as a bi-metallic spring 23 which is constructed and arranged to close the opening 24 of the air conduit 21 when the operating temperature is normal and to uncover the opening 24 of the air conduit 21 when the motor temperature exceeds normal, thus providing an open communication between the motor space 11 and the valve 18.

Figure 3:
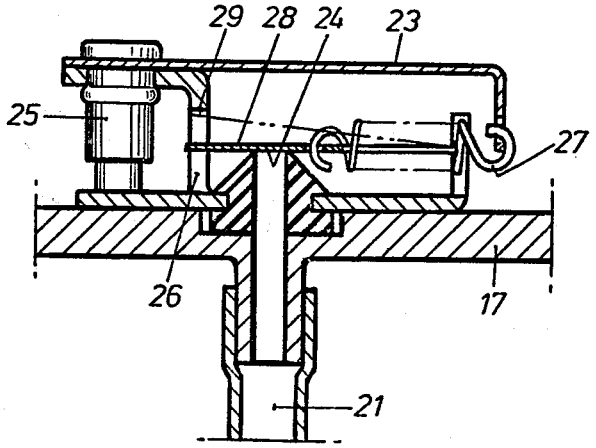
FIG. 3 is a cross-sectional view on an enlarged scale of the temperature sensing assembly of the present device.

The bi-metallic spring 23 comprises a bendable bimetal strip in which the action is adjustable by means of an adjusting screw 25. A rocker plate 28 is shown pivotable on the support 26 and is connected to the strip by a spiral spring 27. When the operating temperature of the motor is normal the rocker plate 28 assumes the solid line position shown in FIG. 3 in which the opening 24 of the air conduit 21 is closed. However, at a predetermined temperature which exceeds the normal operating temperature of the motor, the plate 28 will pivot due to the bending of the bi-metal strip, and the plate 28 will assume the position shown in dotted lines in which it abuts a stop surface 29 of the temperature sensing assembly. In this latter position the air conduit opening 24 is open and the inlet opening 30 of the valve 18 communicates with the motor space 11 via the conduit 21.

As seen in FIG. 2, the inlet opening 30 is located in the lower part of the valve 18. A chamber 33 is also formed in the lower part of the valve which is divided into two parts by means of the diaphragm 31. A through hole 34 appears in the bottom of the chamber by which the latter communicates with the space 13 outside the dust container 14. The upper side of the diaphragm 31 supports an upstanding rod 35, the free end of which is provided with a valve body 36 that functions to close the opening 19. Another space 32 in the valve body is separated from the chamber 33 by means of a partition 37 having a central opening 38 for accommodating the rod 35. It will be noted that the valve body 36 is normally biased into the closed position against the inner edges of the opening 19 by means of a spring 39 having one end resting on the upper surface of the spring 39 while the other end engages the valve body. The entire valve assembly 18 is enclosed by a casing C which is provided with at least one aperture 40 located above the partition 37. Thus, atmospheric air flows to the space outside the dust container 14 when the opening 19 is uncovered by the valve body 36.

During normal operation air passes through the dust container 14, and after separation of the dust from the air, the latter flows further through the openings 15 and 16, shown in FIG. 1, to the suction side of the fan. From the fan the air passes through the motor, thereby cooling it, and leaves the motor space 11 by means of an outlet opening (not shown).

During the continued operation of the vacuum cleaner the dust container pores become clogged causing the flow resistance of the air to increase and consequently the air flow per unit of time is reduced. This results in an increased load on the motor causing increased motor temperature due to impaired cooling. The temperature of the bi-metal strip increases until the rocker plate 28 which closes the opening 24 of the air conduit 21 at a given temperature pivots to its second position as shown in dotted lines and abuts the stop surface 29. In this position, the opening 24 is uncovered.

Referring to FIGS. 1 and 2, it will be observed that the pressure P in motor space 11 is somewhat higher than atmospheric pressure. Thus, air will flow through the air conduit 21 to the chamber 33 of the valve 18. Shortly before this occurs, all the spaces in the valve have the same pressure $R_2$ as well as the dust collecting space 13, which is less than $P_1$. This condition is due to the communication between these spaces and the dust collecting space 13. The action of the valve 18 is such that when air of the pressure $P_1$ flows to the chamber 33 the diaphragm 31 as well as the rod 35 connected thereto and the valve body 36 moves downwardly against the action of the spring so that the opening 24 is uncovered permitting atmospheric air to enter the interior of the vacuum cleaner housing.

As seen in FIG. 2, atmospheric air can flow through the opening 19 and the apertures 40 directly into the space 13 and about the dust container 14. The air flow further passes to the suction side of the fan without passing through the dust container. Thus, the air flow which continues on through the motor 10 will increase and cause improved cooling, thereby eliminating the risk of overloading and overheating of the motor.

Although not shown it is possible to have a signal device, such as a lamp on the vacuum cleaner housing, which is operated by the movement of the rocker plate 28 to indicate when it is desirable to change the dust container or bag 14 of the vacuum cleaner.

What is claimed is:

1. A temperature-responsive vacuum cleaner motor cooling device comprising a vacuum cleaner housing having a first and second compartments at least one fan driven by the vacuum cleaner motor, a dust container, communicating with an inlet the latter together with said motor and fan being located within said housing, said fan when operating functioning to transport air through said compartments while the dust is separated out in said dust container, a temperature sensing means for and adjacent said motor, a valve having a valve body normally covering an opening in said housing and comprising a chamber provided with a diaphragm, one part of said chamber on one side of said diaphragm having an opening communicating with said first compartment in a first space being located between said dust container and the suction side of said fan, an air conduit connecting said one part of said chamber on said one side of the diaphragm to said second compartment downstream of the fan and having a higher pressure and housing said motor, and a blocking means associated with said air conduit and said temperature responsive means being acted upon by said temperature sensing means when the motor temperature is too high to open said valve and thereby establish communication between the atmosphere and said first space and said motor whereby cooling air is permitted to flow about said motor.

2. A device as claimed in claim 1 wherein said temperature sensing means is a bimetallic spring.

3. A device as claimed in claim 1 wherein said valve is provided with an upstanding rod, said valve body being connected to said rod at the free end thereof, the other end of said rod being connected to said diaphragm, a spring acting against said valve body to normally urge the same to cover the opening in said housing, and when said diaphragm is moved in a predetermined direction against the spring bias said opening is uncovered.

4. A device as claimed in claim 1 further providing the other part of said chamber located on the other side of said diaphragm, and a hole in said other part communicating with said first space.

5. A device as claimed in claim 1 wherein said one part of the chamber is provided with an upper portion that has peripheral apertures for the passage of atmospheric air flowing through the opening in said housing to the space adjacent to the outside of said dust container and further to the suction side of said fan.

6. A device as claimed in claim 5 wherein said chamber is further provided with a partition having an opening therethrough separating said upper portion from said one part of said chamber, an upstanding rod provided with a valve body at the free end thereof, and means normally urging said valve body to a position to cover said opening in the housing, said rod passing through the opening in said partition.

* * * * *